US009027196B1

(12) United States Patent
Solak

(10) Patent No.: US 9,027,196 B1
(45) Date of Patent: May 12, 2015

(54) APPLICATOR AND BEAD FINISH TOOL

(71) Applicant: David M. Solak, Seven Hills, OH (US)

(72) Inventor: David M. Solak, Seven Hills, OH (US)

( * ) Notice: Subject to any disclaimer, the term of this patent is extended or adjusted under 35 U.S.C. 154(b) by 11 days.

(21) Appl. No.: 13/799,966

(22) Filed: Mar. 13, 2013

(51) Int. Cl.
*A47L 13/08* (2006.01)
*E04F 21/165* (2006.01)
*B05C 17/10* (2006.01)

(52) U.S. Cl.
CPC ..... *E04F 21/165* (2013.01); *E04F 21/1655* (2013.01); *B05C 17/10* (2013.01); *E04F 21/1652* (2013.01); *A47L 13/08* (2013.01)

(58) Field of Classification Search
CPC . E04F 21/165; E04F 21/1652; E04F 21/1655; E04F 21/16; B05C 17/10; B05C 17/00516; A47L 13/08
USPC ..... 15/230.01, 230.08, 230.07, 235.3, 15/235.7, 235.8, 245–245.1; 30/169, 320; 425/458
See application file for complete search history.

(56) References Cited

U.S. PATENT DOCUMENTS

| | | | | |
|---|---|---|---|---|
| 1,000,333 | A * | 8/1911 | Hall | 15/245.1 |
| 1,975,357 | A | 10/1934 | Dunn | |
| 2,051,199 | A * | 8/1936 | Christianson | 30/320 |
| 2,239,585 | A | 4/1941 | Amundsen | |
| 2,256,847 | A * | 9/1941 | Osenberg | 407/56 |
| 2,318,585 | A | 5/1943 | Abrahamsen | |
| 2,472,124 | A | 6/1949 | Randall et al. | |
| 3,791,014 | A | 2/1974 | Perna | |
| 3,824,165 | A | 7/1974 | Miranda et al. | |
| D274,567 | S | 7/1984 | Levy | |
| 4,907,955 | A | 3/1990 | Snipes | |
| 4,920,647 | A | 5/1990 | Riley | |
| 5,075,916 | A * | 12/1991 | Englehart | 15/245.1 |
| 5,239,725 | A * | 8/1993 | White | 15/105.5 |
| 5,272,782 | A | 12/1993 | Hutt | |
| D389,720 | S | 1/1998 | Warner et al. | |
| 5,759,590 | A | 6/1998 | Cacossa | |
| 5,792,489 | A | 8/1998 | Liberman | |
| 5,974,746 | A | 11/1999 | Mathias | |
| 6,035,536 | A | 3/2000 | Dewberry | |
| 6,427,274 | B1 | 8/2002 | Abbot | |
| 6,530,098 | B1 | 3/2003 | Gringer et al. | |
| 6,715,210 | B2 | 4/2004 | Choa | |
| 6,729,088 | B2 * | 5/2004 | Corr | 52/290 |
| 7,103,936 | B1 | 9/2006 | Brandon | |
| 7,343,639 | B2 * | 3/2008 | Dranginis et al. | 15/236.02 |
| 7,647,668 | B2 | 1/2010 | Meyerl | |
| 7,793,378 | B1 | 9/2010 | Kirby | |
| 7,908,702 | B2 | 3/2011 | Accumanno | |
| 2007/0169298 | A1 * | 7/2007 | Marshall, III | 15/235.7 |
| 2011/0271477 | A1 | 11/2011 | Lien | |

* cited by examiner

FOREIGN PATENT DOCUMENTS

| | | |
|---|---|---|
| EP | 0 924 366 | 6/1999 |
| GB | 159019 | 2/1921 |
| WO | WO 97/14856 | 4/1997 |

*Primary Examiner* — Laura C Guidotti
(74) *Attorney, Agent, or Firm* — Curatolo Sidoti Co., LPA; Salvatore A. Sidoti; Daniel E. Moderick, Jr.

(57) ABSTRACT

A tool for applying a building material and for finishing a bead of building material. The tool includes a handle portion and a flat blade portion having spaced-apart side edges and a front edge. The blade portion of the tool may be provided with an angled portion extending between the front edge and at least one of the side edges of the blade portion or provided with at least one area of weakness extending between the front edge and at least one of the side edges of the blade portion.

27 Claims, 10 Drawing Sheets

SECTION "A-A"

SECTION "A-A"

SECTION "A-A"

SECTION "A-A"

SECTION "A-A"

SECTION "A-A"

SECTION "A-A"

SECTION "A-A"

SECTION "A-A"

APPLICATOR AND BEAD FINISH TOOL

TECHNICAL FIELD

This disclosure relates to a tool for use in building, construction, and repair applications. The tool may be used for applying a building material to a target substrate and for finishing a bead of adhesive, caulk, or sealant.

BACKGROUND

In many constructions or assemblies, there are unavoidable clearances, such as gaps, joints, seams, or the like, which are difficult to seal the openings of the clearances. For instance, the gaps of adjacent sheets of drywall, the seams between adjacent ceramic tiles, and the joints between two adjacent wooden pieces are difficult to be sealed by the materials.

In order to seal or close those clearances, construction adhesives, caulks and sealants are widely applied to the clearances or gaps. The application of the caulk or sealant material seals the gap and prevents the penetration of water, air, liquids, gases, and/or debris.

The caulk or sealant material normally is provided in an initially flowable state. The caulk or sealant material is converted to a solid after it is applied to the construction gap or opening and cured. The flowable sealant is commonly contained within a container such as a flexible paper or polymeric tube or rigid tube. The container is typically engaged with a mechanical application such as a caulking gun for application to a target gap or opening in a construction. The sealant is dispensed through a narrowing nozzle tip of the caulking gun to conveniently apply sealant to the gap or opening.

After filling the gap or openings with the sealant, the applicator may have to use a tool for smoothing and/or shaping the sealant applied on the gaps and openings, so that the sealant is able to be sufficiently filled within the opening for sealing and adhering purposes. If the sealant is not smoothed and shaped by any tool, the surface of the sealant may be unevenly seated at the openings and have an aesthetically unpleasing appearance.

The applicator often uses his finger to press on the sealant applied along the length of the gap or opening, so that the sealant is able to be nicely shaped and smoothed, so as to enhance the adhesiveness between the target substrate and the sealant and to finish the assembly into an aesthetically pleasing and smooth finish.

Although the operation of shaping and smoothing the sealant with the human finger is quick and easy, there are some disadvantages. First, the sealants may contain varieties of chemicals according to the applications of sealants, wherein the containing chemicals of the sealant possibly harmful to the human skin on the finger, so that using the human finger for operating the smooth and shape process of the sealant may be dangerous to human beings. It is also cumbersome to wash the remaining sealant on the finger of human hand. It may be hard to wash away the chemical compounds of the sealant when the chemicals are stained on the finger. If the user used their nails as the rigid spatulas for spreading and shaping the sealant, the sealant tends to deeply stick within the nails, so that cleaning the finger after shaping or smoothing the sealant thereby is even more painful.

Importantly, the use of the human finger to shape and smooth a continuous bead of construction adhesive, caulk, or sealant may lead to inconsistent results in the final aesthetic appearance of the bead of material.

In order to avoid contacting the human finger with the chemicals of the sealants, the current market provides the spatulas or spreader tool for shaping the sealant. Although those tools might be able to protect the human fingers, the structures of spatulas tools do not have the abilities for universally matching and reaching the narrow openings. The openings may be formed by two objects extended to form varieties of angles therebetween, so that the spatulas can not be satisfied for optimum of manipulation of shaping or smoothing the sealants. Therefore, there is a need for an improved tool for shaping and smoothing construction adhesives, caulks, and sealants that are applied to gap or openings.

SUMMARY

According to a first illustrative embodiment, the tool comprises a handle portion, a blade portion having spaced apart side edges and a front edge, and an angled edge extending from said front edge and at least one of said spaced apart side edges of said blade portion.

The tool may comprise a handle portion, a blade portion having spaced apart side edges and a front edge, and an angled edge extending from said front edge and one of said spaced apart side edges of said blade portion.

The tool may comprise a handle portion, a blade portion having spaced apart side edges and a front edge, and an angled edge extending from said front edge and both spaced apart side edges of said blade portion.

According to a second illustrative embodiment, the tool comprises a handle portion, a blade portion having spaced apart side edges and a front edge, and at least one area of weakness formed in the blade portion and extending between said front edge and at least one of said spaced apart side edges of said blade portion.

According to a second illustrative embodiment, the tool comprises a handle portion, a blade portion having spaced apart side edges and a front edge, and at least one area of weakness formed in the blade portion and extending between said front edge and one of said spaced apart side edges of said blade portion.

According to a second illustrative embodiment, the tool comprises a handle portion, a blade portion having spaced apart side edges and a front edge, and at least one area of weakness formed in the blade portion and extending between said front edge and both of said spaced apart side edges of said blade portion.

DETAILED DESCRIPTION

Figure 1:
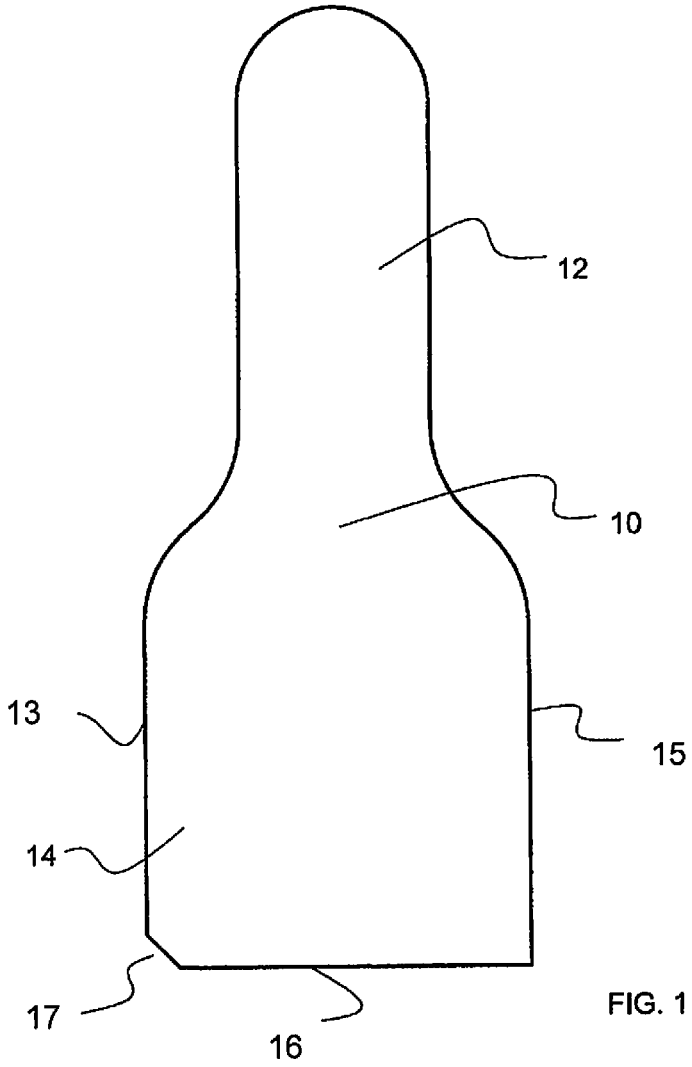
FIG. 1 is a plan view of an illustrative embodiment of the tool.

Disclosed is a multiple use tool for building, construction, repair, and renovation applications. The tool may be used for applying a building material, such as a drywall compound, to a target building substrate, and for shaping and smoothing a bead of caulk or sealant material that has been applied to a narrow opening or joint.

The tool comprises a handle portion, a blade portion having spaced apart side edges and a front edge, and an angled edge extending from the front edge and at least one of the spaced apart side edges of the blade portion.

According to certain illustrative embodiments, the tool comprises a handle portion, a blade portion having spaced apart side edges and a front edge, and an angled edge extending between the front edge and one of the spaced apart side edges of the blade portion.

According to other illustrative embodiments, the tool comprises a handle portion, a blade portion having spaced apart side edges and a front edge, and angled edges extending from the front edge and both of the spaced apart side edges of the blade portion.

According to further illustrative embodiments, the tool comprises a handle portion and a blade portion having spaced apart side edges and a front edge. The blade portion includes at least one area of weakness that is formed in the blade portion.

According to certain embodiments, the tool comprises a handle portion and a blade portion having spaced apart side edges and a front edge. The blade portion of the tool comprises one area of weakness formed in the blade portion of the tool.

According to other illustrative embodiments, the tool comprises a handle portion and a blade portion having spaced apart side edges and a front edge. The blade portion of the tool comprises a plurality of areas of weakness that are formed in the blade portion.

According to certain embodiments, the tool comprises a handle portion and a blade portion having spaced apart side edges and a front edge. The blade portion of the tool comprises one area of weakness extending at an angle between the front edge and one of the side edges of the blade portion.

According to certain embodiments, the tool comprises a handle portion and a blade portion having spaced apart side edges and a front edge. The blade portion of the tool comprises one area of weakness extending at an angle between the front edge and one of the side edges of the blade portion, and one area of weakness extending at an angle between the front edge and the other side edge of the blade portion.

According to other illustrative embodiments, the tool comprises a handle portion and a blade portion having spaced apart side edges and a front edge. The blade portion of the tool comprises a plurality of areas of weakness extending at an angle between the front edge and both of the side edges of the blade portion.

According to other illustrative embodiments, the tool comprises a handle portion and a blade portion having spaced apart side edges and a front edge. The blade portion of the tool comprises one area of weakness extending at an angle between the front edge and one of the side edges of the blade portion, and a plurality of areas of weakness each extending at an angle between the front edge and the other spaced apart side edge of the blade portion.

According to other illustrative embodiments, the tool comprises a handle portion and a blade portion having spaced apart side edges and a front edge. The blade portion of the tool comprises one area of weakness extending at an angle between the front edge and one of the side edges of the blade portion, and two areas of weakness each extending at an angle between the front edge and the other spaced apart side edge of the blade portion.

According to other illustrative embodiments, the tool comprises a handle portion and a blade portion having spaced apart side edges and a front edge. The blade portion of the tool comprises one area of weakness extending at an angle between the front edge and one of the side edges of the blade portion, and three areas of weakness each extending at an angle between the front edge and the other spaced apart side edge of the blade portion.

According to other illustrative embodiments, the tool comprises a handle portion and a blade portion having spaced apart side edges and a front edge. The blade portion of the tool comprises one area of weakness extending at an angle between the front edge and one of the side edges of the blade portion, and four areas of weakness each extending at an angle between the front edge and the other spaced apart side edge of the blade portion.

According to other illustrative embodiments, the tool comprises a handle portion and a blade portion having spaced apart side edges and a front edge. The blade portion of the tool comprises two areas of weakness extending at an angle between the front edge and one of the side edges of the blade portion, and two areas of weakness each extending at an angle between the front edge and the other spaced apart side edge of the blade portion.

According to other illustrative embodiments, the tool comprises a handle portion and a blade portion having spaced apart side edges and a front edge. The blade portion of the tool comprises two areas of weakness each extending at an angle between the front edge and one of the side edges of the blade portion, and three areas of weakness each extending at an angle between the front edge and the other spaced apart side edge of the blade portion.

According to other illustrative embodiments, the tool comprises a handle portion and a blade portion having spaced apart side edges and a front edge. The blade portion of the tool comprises two areas of weakness each extending at an angle between the front edge and one of the side edges of the blade portion, and four areas of weakness each extending at an angle between the front edge and the other spaced apart side edge of the blade portion.

The phrase "area of weakness" as used herein refers to a location or multiple locations on the blade portion that have less strength than other areas of the blade or handle portions of the tool. The least one area (i.e., one or more than one area) of weakness is provided in the blade portion of the tool to permit the user to break, cut, snip, or snap off a corner portion of the blade portion of the tool along the line of weakness to form an angled edge extending between the front edge of the blade portion of the tool and a side edge of the blade portion.

The one or more area(s) of weakness formed in the blade portion may include at least one perforated line, a scored line, depression, groove, trough, elongated raised ridges, any other form that provides an area of weakness, and combinations of any of these. According to certain illustrative embodiments having multiple areas of weakness extending at an angle between the front edge and the side edge(es) of the tool, the areas of weakness comprises spaced-apart lines of weakness extending from the front edge to a side edge of the blade handle of the tool.

The angled edge or edges extending between the front edge of the blade portion of the side edges of the blade portion are provided to smooth and shape a bead construction adhesive, caulk, or sealant material. The bead angle may that may be formed in the distal portion of the blade portion of the tool may be ⅛", ¼", ⅜", or ½". According to certain illustrative embodiments, the tool includes a bead angle edge of ⅜".

The area or areas of weakness may be color coded to assist the user in obtaining the desired caulk or sealant bead angle size.

According to certain illustrative embodiments, the area of weakness comprises a line of depressions formed in a first surface of the blade portion of the tool.

According to other illustrative embodiments, the area of weakness may comprise a line of depressions formed in both opposing first and second surfaces of the blade portion of the tool.

According to certain illustrative embodiments, there are a plurality of areas of weakness comprising a plurality of spaced apart lines of depressions formed in a first surface of the blade portion of the tool.

According to other illustrative embodiments, there are a plurality areas of weakness comprising spaced apart lines of depressions formed in both opposing first and second surfaces of the blade portion of the tool.

According to certain illustrative embodiments, the area of weakness comprises continuous or discontinuous raised ridges formed in a first surface of the blade portion of the tool.

According to other illustrative embodiments, the area of weakness comprises continuous or discontinuous raised ridges formed in both opposing first and second surfaces of the blade portion of the tool.

According to certain illustrative embodiments, there are a plurality of areas of weakness comprising a plurality of spaced apart lines of continuous or discontinuous raised ridges formed in a first surface of the blade portion of the tool.

According to other illustrative embodiments, there are a plurality areas of weakness comprising spaced apart lines of continuous or discontinuous raised ridges formed in both opposing first and second surfaces of the blade portion of the tool.

According to the illustrative embodiments of the tool where the at least one area of weakness is created by depressions, the depressions may comprise any suitably shaped depression formed in the blade portion of the tool. Without limitation, and only by way of illustration, the depressions may be provided in the form of substantially concave depressions, substantially cup-shaped depressions, substantially bowl shaped depressions, or any other suitably shaped trough or depression formed partially into the thickness of the blade portion of the tool.

According to the illustrative embodiments of the tool where the at least one area of weakness is created by raised ridges, the raised ridges may comprise any suitably shaped ridges extending outwardly from an outer surface of the blade portion of the tool. Without limitation, and only by way of illustration, the depressions may be provided in the form of substantially convex ridges, inverted cup-shaped ridges, inverted bowl shaped depressions, V-shaped ridges, or any other suitably shaped raised ridge that extends outwardly from the outer surface of the blade portion of the tool.

The tool may be manufactured from a material selected from metals, metal alloys, polymers, composite materials, wood, and combinations thereof. According to certain illustrative embodiments, both the handle portion of the tool and the blade portion of the tool are manufactured from the same material. According to other illustrative embodiments, the handle portion of the tool and the blade portion of the tool are manufactured from the same material.

According to certain illustrative embodiments, the handle portion and the blade portion of the tool comprises an integral, one-piece body. The integral body comprising the handle portion and blade portion may be manufactured from natural polymers, synthetic polymers, or a mixture of natural and synthetic polymers. The polymer may be semi-rigid or rigid. Without limitation, and only by way of illustration, the polymers that may be used to manufacture the tool are selected from polyalkylenes and polyvinyl chloride (PVC). Suitable polyalkylenes include, for example, polyethylene and polypropoylene.

According to other illustrative embodiments, the handle portion and the blade portion of the tool comprise separate pieces that are connected together by at least one connecting member. The connecting member used to connect the handle portion of the tool to the blade portion of the tool may be any suitable connecting member that is able to securely connect the handle portion to the blade portion. By way of illustrative, but not in limitation, suitable connecting members that may used to connect or other attach the handle portion of the tool to the blade portion of the tool may be selected from bolts, screws, nails, rivets, tacks, and the like.

The illustrative embodiments of the tool will now be described in greater detail with reference to the various drawing FIGURES. It should be noted that the embodiments of the tool shown in the drawing FIGURES are merely illustrative and the present disclosure should not be limited in any manner or way by the drawing FIGURES.

FIG. 1 shows an illustrative embodiment of the tool 10. Tool 10 includes a handle portion 12 and a blade portion 14. Blade portion 14 of tool 10 includes spaced apart side edges 13, 15 and front edge 16. Tool 10 also includes an angled edge 17 which extends between side edge 13 and front edge 16.

Figure 2:
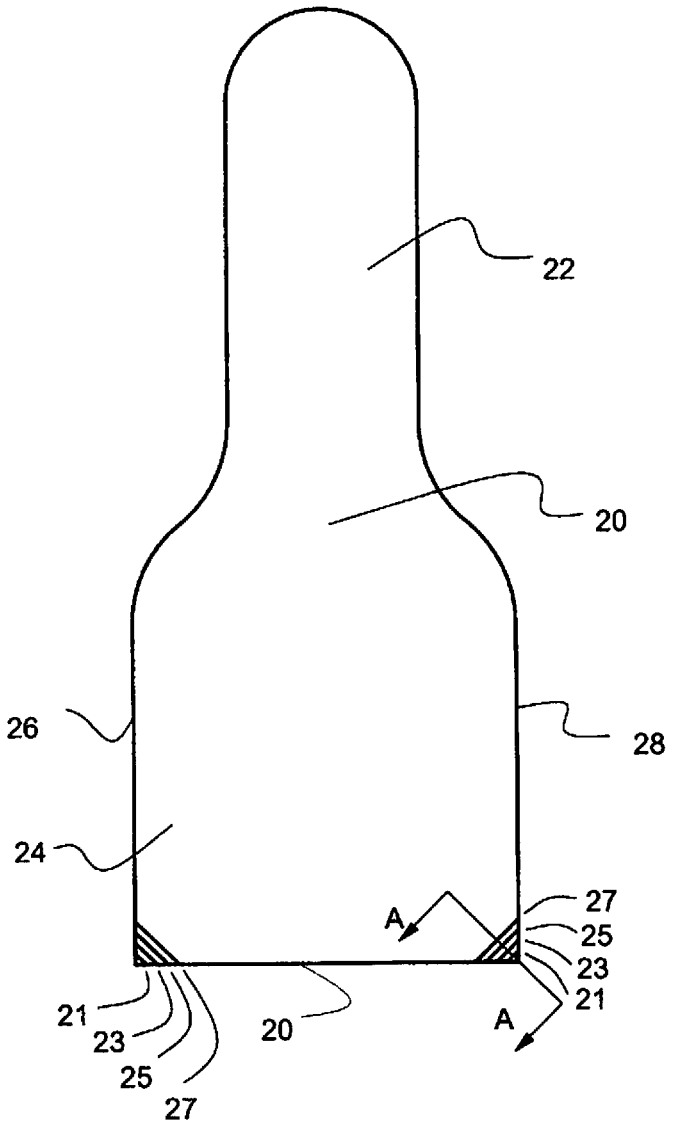
FIG. 2 is another illustrative embodiment of the tool.

FIG. 2 shows another illustrative embodiment of the tool. Tool 20 includes a handle portion 22 and a blade portion 24. Blade portion 24 of tool 20 includes spaced apart side edges 26, 28 and front edge 20. Tool 20 also includes a plurality of lines of weakness 21, 23, 25, 27 formed in the blade portion 24 of tool 20.

Figure 3:
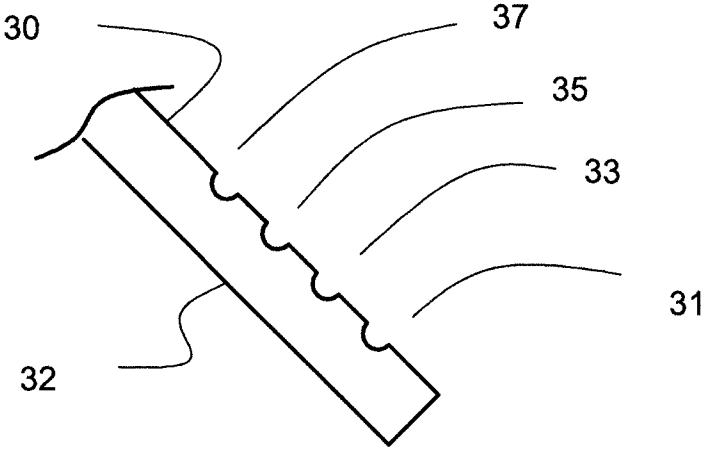
FIG. 3 is a cross section view of FIG. 2 taken along line A-A depicting a first illustrative embodiment of the angled edge of the tool.

FIG. 3 is a cross section of one of the corners of the blade portion 24 of tool 20 of FIG. 2. Blade portion 24 of tool 20 includes opposite facing first 30 and second 32 surfaces. A plurality of spaced apart cup-shaped grooves 31, 33, 35, 37 are formed in the first surface 30 of the blade portion 24. Cup-shaped grooves 31, 33, 35, 37 extend partially into the thickness of the blade portion 24 of tool 20.

Figure 4:
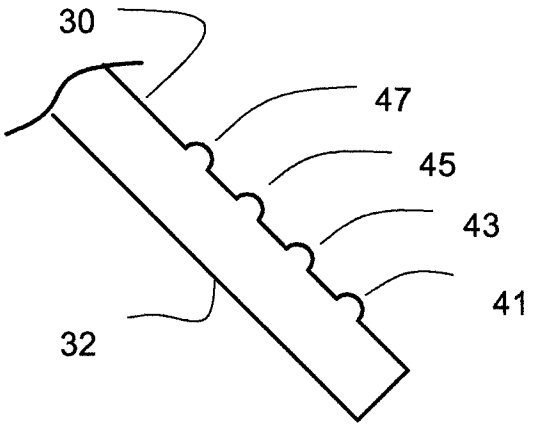
FIG. 4 is a cross section view of FIG. 2 taken along line A-A depicting a second illustrative embodiment of the angled edge of the tool.

FIG. 4 is a cross section of one of the corners of the blade portion 24 of tool 20 of FIG. 2. Blade portion 24 of tool 20 includes opposite facing first 30 and second 32 surfaces. A plurality of spaced apart raised ridges 41, 43, 45, 47 formed in the first surface 30 of the blade portion 24. Cup-shaped raised ridges 41, 43, 45, 47 extend outwardly from the outer surface 30 the blade portion 24 of tool 20.

Figure 5:
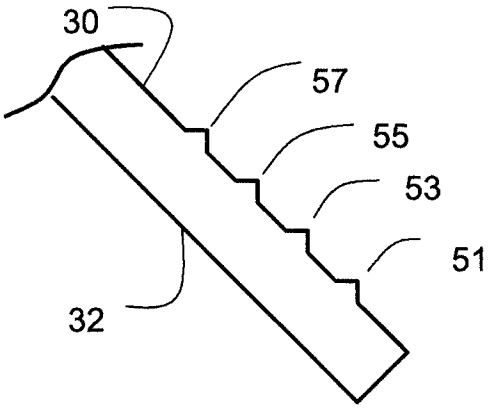
FIG. 5 is a cross section view of FIG. 2 taken along line A-A depicting a third illustrative embodiment of the angled edge of the tool.

FIG. 5 is a cross section of one of the corners of the blade portion 24 of tool 20 of FIG. 2. Blade portion 24 of tool 20 includes opposite facing first 30 and second 32 surfaces. A plurality of spaced apart V-shaped ridges 51, 53, 55, 57 are formed in the first surface 30 of the blade portion 24.

V-shaped ridges 51, 53, 55, 57 extend partially into the thickness of the blade portion 24 of tool 20.

Figure 6:
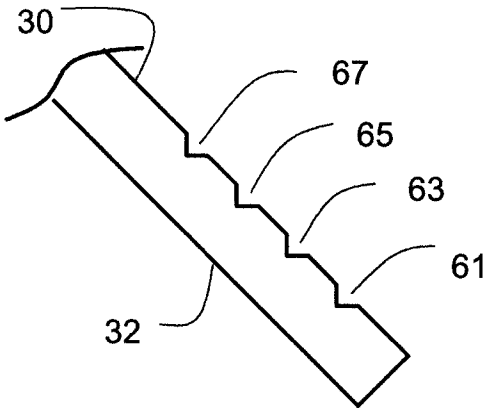
FIG. 6 is a cross section view of FIG. 2 taken along line A-A depicting a fourth illustrative embodiment of the angled edge of the tool.

FIG. 6 is a cross section of one of the corners of the blade portion 24 of tool 20 of FIG. 2. Blade portion 24 of tool 20 includes opposite facing first 30 and second 32 surfaces. A plurality of spaced apart V-shaped grooves 61, 63, 65, 67 formed in the first surface 30 of the blade portion 24. Cup-shaped raised grooves 61, 63, 65, 67 extend outwardly from the outer surface 30 the blade portion 24 of tool 20.

Figure 7:
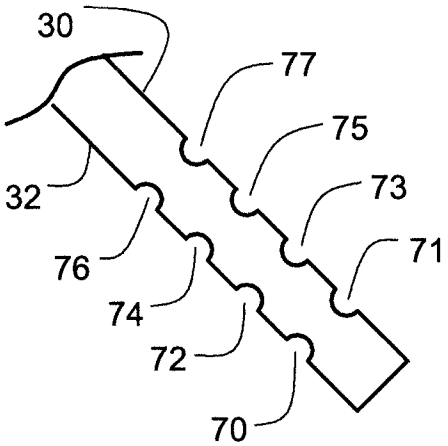
FIG. 7 is a cross section view of FIG. 2 taken along line A-A depicting a fifth illustrative embodiment of the angled edge of the tool.

FIG. 7 is a cross section of one of the corners of the blade portion 24 of tool 20 of FIG. 2. Blade portion 24 of tool 20 includes opposite facing first 30 and second 32 surfaces. A plurality of spaced apart cup-shaped grooves 71, 73, 75, 77 are formed in the first surface 30 of the blade portion 24. Cup-shaped grooves 70, 72, 74, 76 are formed in the second surface 32 of the blade portion 24 of the tool 20. Cup-shaped grooves 70-77 extend partially into the thickness of the blade portion 24 of tool 20.

Figure 8:
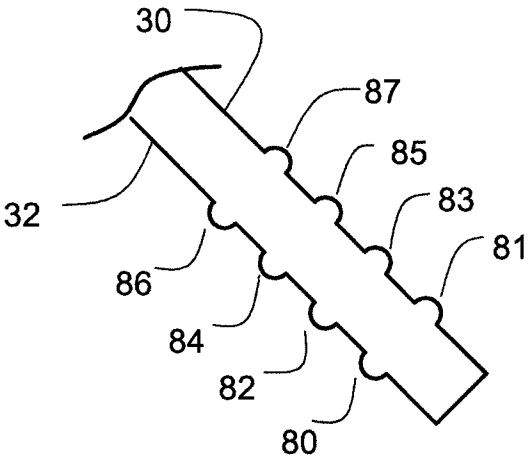
FIG. 8 is a cross section view of FIG. 2 taken along line A-A depicting a sixth illustrative embodiment of the angled edge of the tool.

FIG. 8 is a cross section of one of the corners of the blade portion 24 of tool 20 of FIG. 2. Blade portion 24 of tool 20 includes opposite facing first 30 and second 32 surfaces. A plurality of spaced apart raised ridges 81, 83, 85, 87 formed in the first surface 30 of the blade portion 24. Cup-shaped raised ridges 81, 83, 85, 87 extend outwardly from the outer surface 30 the blade portion 24 of tool 20. A plurality of spaced apart raised ridges 80, 82, 84, 86 formed in the second surface 32 of the blade portion 24. Cup-shaped raised ridges 80-87 extend outwardly from the outer surfaces 30, 32 the blade portion 24 of tool 20.

Figure 9:
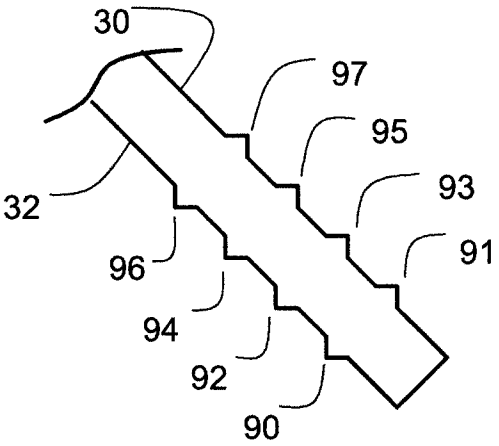
FIG. 9 is a cross section view of FIG. 2 taken along line A-A depicting a seventh illustrative embodiment of the angled edge of the tool.

FIG. 9 is a cross section of one of the corners of the blade portion 24 of tool 20 of FIG. 2. Blade portion 24 of tool 20 includes opposite facing first 30 and second 32 surfaces. A plurality of spaced apart V-shaped ridges 91, 93, 95, 97 are formed in the first surface 30 of the blade portion 24. V-shaped ridges 90, 92, 94, 96 are formed in the second surface 32 of the blade portion 24 of the tool 20. V-shaped ridges 90-97 extend partially into the thickness of the blade portion 24 of tool 20.

Figure 10:
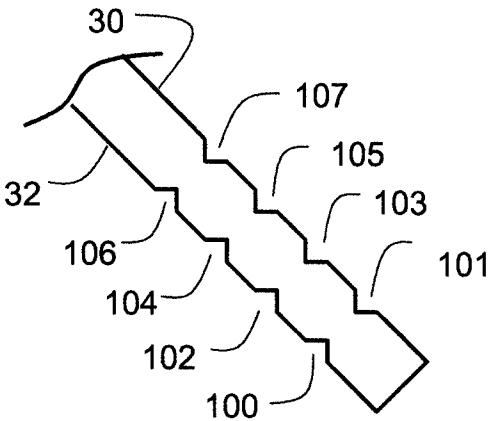
FIG. 10 is a cross section view of FIG. 2 taken along line A-A depicting a eighth illustrative embodiment of the angled edge of the tool.

FIG. 10 is a cross section of one of the corners of the blade portion 24 of tool 20 of FIG. 2. Blade portion 24 of tool 20 includes opposite facing first 30 and second 32 surfaces. A plurality of spaced apart V-shaped grooves 101, 103, 105, 107 formed in the first surface 30 of the blade portion 24. V-shaped grooves 101, 103, 105, 107 extend outwardly from the outer surface 30 the blade portion 24 of tool 20. A plurality of spaced apart V-shaped grooves 100, 102, 104, 106 formed in the second surface 32 of the blade portion 24. V-shaped grooves 100-107 extend outwardly from the outer surfaces 30, 32 the blade portion 24 of tool 20.

The invention claimed is:

1. A tool comprising:

a handle portion;

a blade portion having spaced apart side edges and a front edge; and one area of weakness formed in the blade portion, wherein said area of weakness comprises a depression formed in opposing first and second surfaces of said blade portion of said tool, and wherein said depressions comprise a plurality of substantially concave depressions.

2. The tool of claim 1, wherein said handle portion and said blade portion comprise an integral body.

3. The tool of claim 2, wherein said integral body comprises a material selected from the group consisting of metals, metal alloys, polymers, and composite materials.

4. The tool of claim 3, wherein said material comprises a polymer.

5. The tool of claim 4, wherein said polymer is selected from the group consisting of polyalkylenes and polyvinyl chloride.

6. The tool of claim 1, wherein said handle portion and said blade portion comprise separate pieces connected together by at least one connecting member.

7. A tool comprising:

a handle portion;

a blade portion having spaced apart side edges and a front edge; and a plurality of areas of weakness formed in the blade portion, said areas of weakness comprise a plurality of depressions formed in a first surface of said blade portion of said tool, and wherein said depressions comprise substantially concave depressions.

8. The tool of claim 7, wherein said areas of weakness comprises a plurality of depressions formed in opposing first and second surfaces of said blade portion of said tool.

9. The tool of claim 7, wherein said handle portion and said blade portion comprise an integral body.

10. The tool of claim 9, wherein said integral body comprises a material selected from the group consisting of metals, metal alloys, polymers, and composite materials.

11. The tool of claim 10, wherein said material comprises a polymer.

12. The tool of claim 11, wherein said polymer is selected from the group consisting of polyalkylenes and polyvinyl chloride.

13. The tool of claim 7, wherein said handle portion and said blade portion comprise separate pieces connected together by at least one connecting member.

14. A tool comprising:

a handle portion;

a blade portion having spaced apart side edges and a front edge; and one area of weakness formed in the blade portion, wherein said area of weakness comprises a raised ridge formed in opposing first and second surfaces of said blade portion of said tool.

15. The tool of claim 14, wherein said raised ridges comprise a plurality of substantially V-shaped ridges.

16. The tool of claim 14, wherein said handle portion and said blade portion comprise an integral body.

17. The tool of claim 16, wherein said integral body comprises a material selected from the group consisting of metals, metal alloys, polymers, and composite materials.

18. The tool of claim 17, wherein said material comprises a polymer.

19. The tool of claim 18, wherein said polymer is selected from the group consisting of polyalkylenes and polyvinyl chloride.

20. The tool of claim 14, wherein said handle portion and said blade portion comprise separate pieces connected together by at least one connecting member.

21. A tool comprising:

a handle portion;

a blade portion having spaced apart side edges and a front edge; and a plurality of areas of weakness formed in the blade portion, wherein said areas of weakness comprise a plurality of raised ridges formed in opposing first and second surfaces of said blade portion of said tool.

22. The tool of claim 21, wherein said raised ridges comprise substantially V-shaped ridges.

23. The tool of claim 21, wherein said handle portion and said blade portion comprise an integral body.

24. The tool of claim 23, wherein said integral body comprises a material selected from the group consisting of metals, metal alloys, polymers, and composite materials.

25. The tool of claim 24, wherein said material comprises a polymer.

26. The tool of claim 25, wherein said polymer is selected from the group consisting of polyalkylenes and polyvinyl chloride.

27. The tool of claim 21, wherein said handle portion and said blade portion comprise separate pieces connected together by at least one connecting member.

* * * * *